US011091910B2

(12) United States Patent
Langeveld

(10) Patent No.: US 11,091,910 B2
(45) **Date of Patent: *Aug. 17, 2021**

(54) CARRIER FOR A LINEAR CEILING PANEL

(71) Applicant: Hunter Douglas Industries B.V., Rotterdam (NL)

(72) Inventor: Michiel Jacobus Johannes Langeveld, Zoetermeer (NL)

(73) Assignee: HUNTER DOUGLAS INDUSTRIES B.V., El Rotterdam (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/868,020

(22) Filed: May 6, 2020

(65) Prior Publication Data

US 2020/0263426 A1 Aug. 20, 2020

Related U.S. Application Data

(63) Continuation of application No. 15/757,460, filed as application No. PCT/EP2016/071173 on Sep. 8, 2016, now Pat. No. 10,683,664.

(30) Foreign Application Priority Data

Sep. 8, 2015 (NL) ..... 1041464

(51) Int. Cl.
*E04B 9/36* (2006.01)
*E04B 9/06* (2006.01)
(Continued)

(52) U.S. Cl.
CPC ..... *E04B 9/36* (2013.01); *E04B 9/065* (2013.01); *E04B 9/363* (2013.01); *E04B 9/366* (2013.01);
(Continued)

(58) Field of Classification Search
CPC . E04B 9/36; E04B 9/363; E04B 9/366; E04B 9/065; E04B 9/06; E04B 9/26; E04C 2003/0473; E04C 2003/046; E04C 3/09
(Continued)

(56) References Cited

U.S. PATENT DOCUMENTS 2,994,113 A 8/1961 Dail
3,287,874 A * 11/1966 Stahlhut ..... E04B 9/125 52/506.08
(Continued)

FOREIGN PATENT DOCUMENTS

CA 2997831 3/2017
CN 2191898 Y 3/1995
(Continued)

OTHER PUBLICATIONS

Chinese Office Action issued in corresponding Application No. 201680052086X dated May 20, 2019, (2 pages).
(Continued)

*Primary Examiner* — Joshua K Ihezie
(74) *Attorney, Agent, or Firm* — Dority & Manning, P.A.

(57) ABSTRACT

A linear panel mounting system includes a carrier extending in a longitudinal direction and having a recess formed therein, with the recess having with a neck portion and a main portion. The linear panel mounting system further comprises a linear panel having a flexible, resilient flange which extends at least partially along an edge of the panel, with the flange being configured to slot into the recess of the carrier and be retained therein to thereby attach the linear panel to the carrier.

20 Claims, 5 Drawing Sheets

(51) Int. Cl.
*E04C 3/04* (2006.01)
*E04C 3/09* (2006.01)

(52) U.S. Cl.
CPC ..... *E04C 3/09* (2013.01); *E04C 2003/046* (2013.01); *E04C 2003/0473* (2013.01)

(58) Field of Classification Search
USPC ..... 52/772
See application file for complete search history.

(56) References Cited

U.S. PATENT DOCUMENTS

| | | | | |
|---|---|---|---|---|
| 3,548,556 | A | 12/1970 | Vermeulen | |
| 3,678,641 | A * | 7/1972 | Englund | E04B 9/363 52/506.08 |
| 4,297,822 | A | 11/1981 | Rijnders | |
| 4,364,215 | A * | 12/1982 | Gailey | E04B 9/065 403/347 |
| 4,646,506 | A | 3/1987 | Slapsys | |
| 4,757,663 | A | 7/1988 | Kuhr | |
| 5,121,578 | A | 6/1992 | Holz | |
| 7,579,107 | B2 * | 8/2009 | Lu | H01M 2/1066 429/97 |
| 2020/0011055 | A1 | 1/2020 | Langeveld | |

FOREIGN PATENT DOCUMENTS

| | | |
|---|---|---|
| CN | 201024562 Y | 2/2008 |
| CN | 201198616 Y | 2/2009 |
| DE | 2409709 | 9/1975 |
| DE | 2536292 | 2/1977 |
| DE | 2559077 | 7/1977 |
| DE | 2652481 | 5/1978 |
| EP | 0987378 | 3/2000 |
| FR | 2458640 | 1/1981 |
| FR | 2697273 | 4/1994 |
| WO | WO2011020166 | 2/2011 |

OTHER PUBLICATIONS

Patent Cooperative Treaty PCT/EP2016/071173—International Search Report, dated Nov. 18, 2016. (2 pages).

* cited by examiner

L
9
9
9
7
22
21
24
20
19
d1
18
23
16
d
12
14
a
1
11
13
b
15
17
5
3
c 9
31
7
22
21
20
24
19
16
23
12
11
15
3
L

CARRIER FOR A LINEAR CEILING PANEL

CROSS-REFERENCE TO RELATED APPLICATIONS

This application is continuation of U.S. patent application Ser. No. 15/757,460, filed on Mar. 5, 2018, which is a U.S. National Phase Application of PCT Patent Application No. PCT/EP2016/071173, filed on Sep. 8, 2016, which, in turn, is based upon and claims the right of priority to Netherlands Patent Application No. 1041464, filed on Sep. 8, 2015, the disclosures of all of which are hereby incorporated by reference herein in their entirety for all purposes.

The present invention relates to carriers for mounting coverings on a ceiling, and in particular for mounting linear panels on a ceiling.

Linear ceiling panels have a longitudinal length which is substantially greater than their width, the longitudinal length of the panel generally being at least three times the width of the panel, and usually at least five times the width of the panel.

Carriers for mounting ceiling panels are known in the art. The carriers are attached to or are suspended from the structural ceiling or upper part of a wall adjacent to the structural ceiling. The ceiling panel is attached to the carrier, and is thereby mounted on the ceiling.

The present invention seeks to provide an improved carrier which is suitable for mounting linear panels on the ceiling without requiring adhesive or mechanical fastening means such as screws for attaching the ceiling panel to the carrier.

According to the present invention in one embodiment thereof, there is provided a carrier for mounting linear panels on a ceiling, the carrier extending in a longitudinal direction and having at least one recess formed therein, the recess being for receiving a linear ceiling panel, the recess extending through the cross-section of the carrier, the recess being defined by a surface comprising at least a first wall portion and a second wall portion, the recess separating the first wall portion from the second wall portion, and the second wall portion defining a flange which extends at least partially into the recess, thereby providing the recess with a neck portion and a main portion, and wherein the neck portion has, at its narrowest point, a distance d1 of less than 9 mm separating the first wall portion from the second wall portion.

Advantageously, the distance d1 is less than 4.5 mm and preferably less than 3.2 mm. Preferably, the distance d1 is at least 1.5 mm.

The carrier may comprise a plurality of recesses formed therein, each recess being configured to receive the flange of a linear ceiling panel.

The carrier may comprise a plurality of identical recesses formed therein, each recess being configured to receive the flange of a linear ceiling panel.

Alternatively, the carrier may comprise a pair of recesses formed therein, the recesses being mirror images of each other and both recesses being configured to each receive a flange of a linear ceiling panel. Advantageously, the carrier may comprise several pairs of such recesses. Alternatively, the recesses of a pair may be different from each other.

The present invention further provides a linear ceiling panel mounting system comprising the carrier as defined above and further comprising a linear ceiling panel having a flexible, resilient flange which extends along the whole or part of an edge of the panel, the flange being configured to slot into the recess of the carrier and be retained therein to thereby attach the linear ceiling panel to the carrier.

The linear ceiling panel mounting system may comprise a plurality of carriers each comprising a plurality of recesses formed therein, each recess being configured to receive the flange of a linear ceiling panel, and further comprising a plurality of linear ceiling panels as defined above.

The linear ceiling panel mounting system may comprise a plurality of carriers each comprising several pairs of recesses formed therein, the recesses of each pair being mirror images of each other, and the system further comprising a plurality of linear ceiling panels each having a flexible, resilient flange extending along the whole or part of two opposing edges of the panel, both recesses of each pair being configured to each receive a flange of the linear ceiling panel, the flanges of the linear ceiling panel being configured to slot into the recesses of the carrier and be retained therein to thereby attach the linear ceiling panel to the carrier.

The distance d1 is preferably approximately three-quarters to two times the combined thickness of the flange and that part of the panel adjacent the flange. Preferably the distance d1 is approximately 0.75 to 1.00 times the combined thickness of the flange and that part of the panel adjacent the flange.

Each linear ceiling panel preferably has a longitudinal length which is at least three times, and more preferably at least five times, the width of the panel.

In another embodiment of the present invention, the linear ceiling panel mounting system comprises at least one carrier for mounting linear panels on a ceiling, the carrier extending in a longitudinal direction and having at least one recess formed therein, the recess being for receiving a linear ceiling panel, the recess extending through the cross-section of the carrier, the recess being defined by a surface comprising at least a first wall portion and a second wall portion, the recess separating the first wall portion from the second wall portion, and the second wall portion defining a flange which extends at least partially into the recess, thereby providing the recess with a neck portion and a main portion, and wherein the neck portion has, at its narrowest point, a distance d1 separating the first wall portion from the second wall portion, the linear ceiling panel mounting system further comprising a linear ceiling panel having a flexible, resilient flange which extends along the whole or part of an edge of the panel, the flange being configured to slot into the recess of the carrier and be retained therein to thereby attach the linear ceiling panel to the carrier, and wherein the distance d1 is approximately three quarters to two times the combined thickness of the flange and that part of the panel adjacent the flange.

Preferably the distance d1 is approximately 0.75 to 1.00 times the combined thickness of the flange and that part of the panel adjacent the flange.

The carrier may comprise a plurality of recesses formed therein, each recess being configured to receive the flange of a linear ceiling panel.

The carrier may comprise a plurality of identical recesses formed therein, each recess being configured to receive the flange of a linear ceiling panel.

Alternatively, the carrier may comprise a pair of recesses formed therein, the recesses being mirror images of each other and both recesses being configured to each receive a flange of a linear ceiling panel. Advantageously, the carrier may comprise several pairs of such recesses. Alternatively, the recesses of a pair may be different from each other.

The linear ceiling panel mounting system may comprise a plurality of carriers each comprising a plurality of recesses formed therein, each recess being configured to receive the flange of a linear ceiling panel, and further comprising a plurality of linear ceiling panels as defined above.

Advantageously, the linear ceiling panel mounting system may comprise a plurality of carriers each comprising several pairs of recesses formed therein, the recesses of each pair being mirror images of each other, and the system further comprising a plurality of linear ceiling panels each having a flexible, resilient flange extending along the whole or part of two opposing edges of the panel, both recesses of each pair being configured to each receive a flange of the linear ceiling panel, the flanges of the linear ceiling panel being configured to slot into the recesses of the carrier and be retained therein to thereby attach the linear ceiling panel to the carrier.

The linear ceiling panel mounting system of any of the embodiments described above may comprise at least one linear ceiling panel having substantially a "U"-shaped cross-section, and comprising a central region and two side walls extending from the central region, the panel further comprising a flexible, resilient flange extending from each of the side walls, the resilience of the flange acting to retain the angle between each flange and its corresponding side wall at preferably approximately 90° or less.

The flexible, resilient flange is preferably configured to be bent towards the corresponding side wall of the panel to permit insertion of the flange and adjacent side wall of the panel in the neck portion of the recess of the carrier, the angle β of the flange with respect to the adjacent side wall being thereby reduced to 10° or less, more preferably 5° or less and most preferably less than 2°.

The flexible, resilient flange is preferably formed from one or more of:

a thermoformable, non-woven fibrous material; a metal material; a rubber material.

The combined thickness of the flange and that part of the panel adjacent the flange is preferably in the range of 2 mm-12 mm and more preferably in the range of 2 mm-6 mm.

Each linear ceiling panel preferably has a longitudinal length which is at least three times, and more preferably at least five times, the width of the panel.

Further features of the carrier and the linear ceiling panel mounting system are to be found in the appended claims.

The present invention also provides a method of mounting a linear ceiling panel in a carrier comprising the steps of: providing a linear ceiling panel mounting system as described above; bending, prior to or during mounting of the panel, a flange of the panel towards an adjacent part of the panel; inserting the flange and adjacent part of the panel into a recess of the carrier, such that the flange passes past the neck portion of the recess into the main portion of the recess, the resilient nature of the flange then urging the flange to return to its original configuration once it is no longer constrained by the neck portion of the recess.

The present invention will now be described by way of example only and with reference to the following drawings, of which:

Figure 4A:
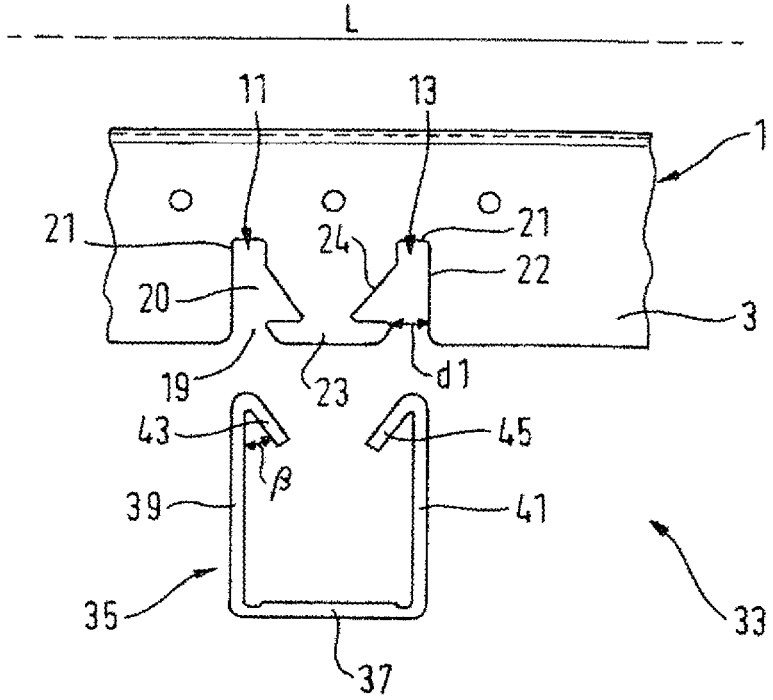
Figure 4B:
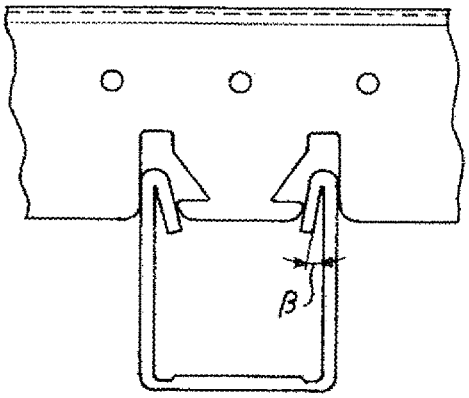
Figure 4C:
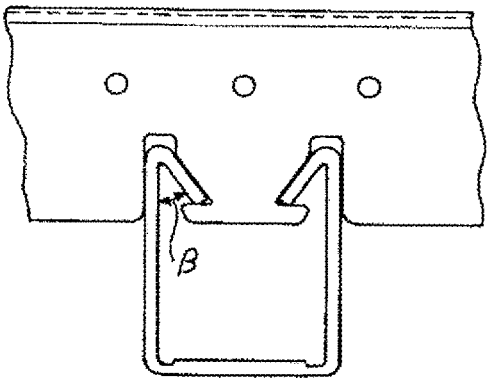

FIGS. 4*a*-4*c* show side views of a linear ceiling panel being mounted in a carrier in accordance with the present invention.

Figure 3:
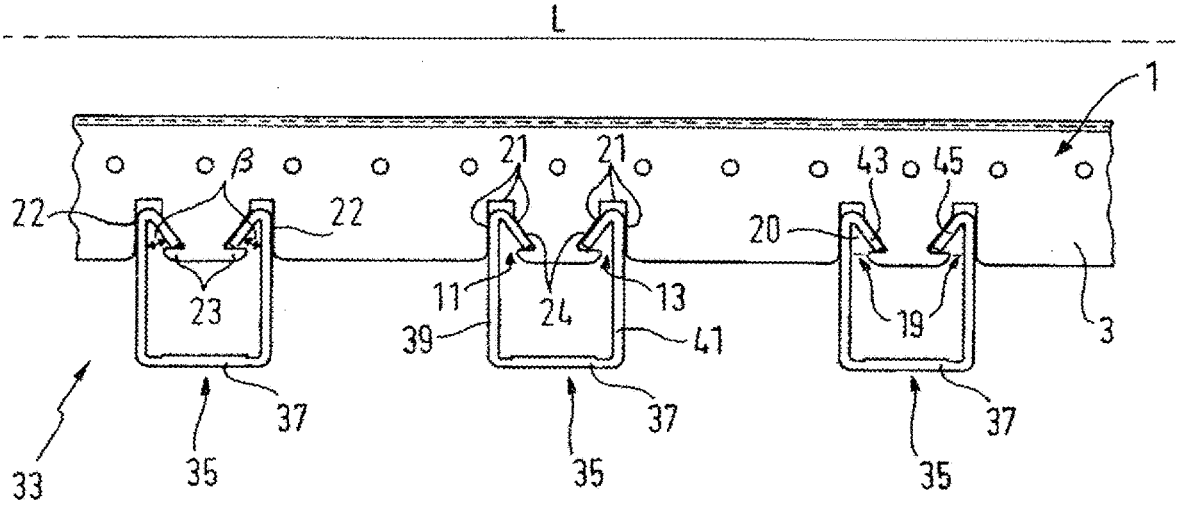
FIG. 3 shows a side view of a carrier in combination with a linear ceiling panel to form a linear ceiling panel mounting system in accordance with a further embodiment of the present invention.
Figure 5:
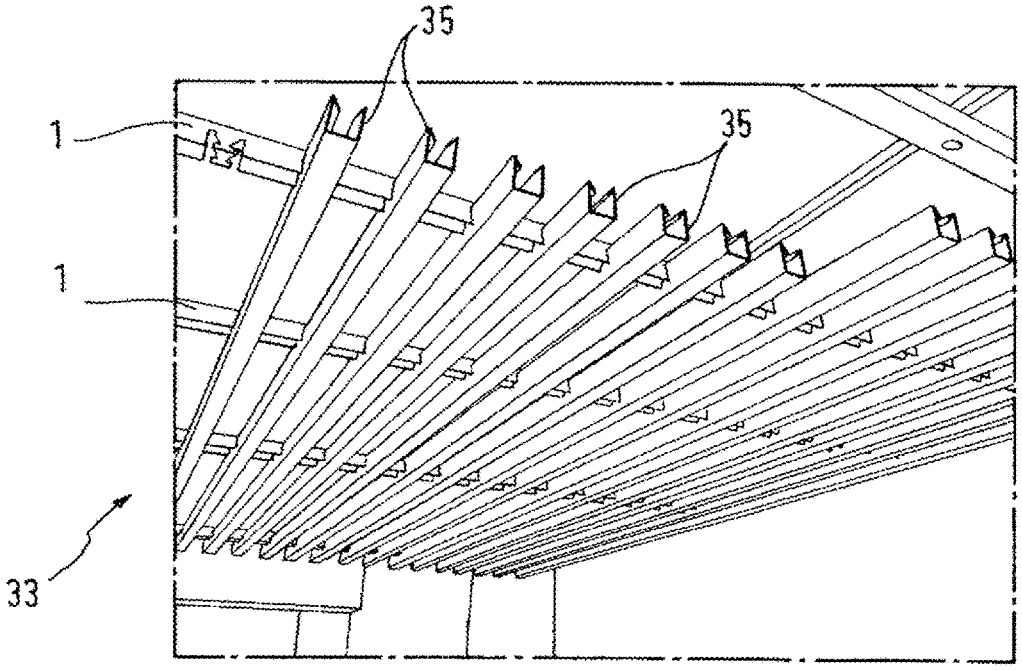

FIG. 5 shows an isometric view of the linear ceiling panel mounting system of FIG. 3.

Figure 6:
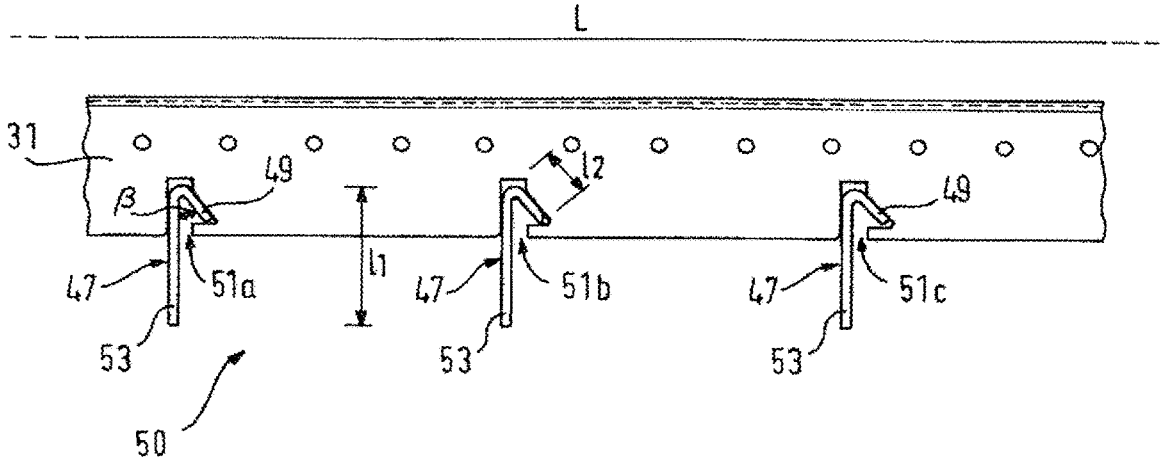

FIG. 6 shows a side view of a further linear ceiling panel mounting system in accordance with the present invention.

Figure 7:
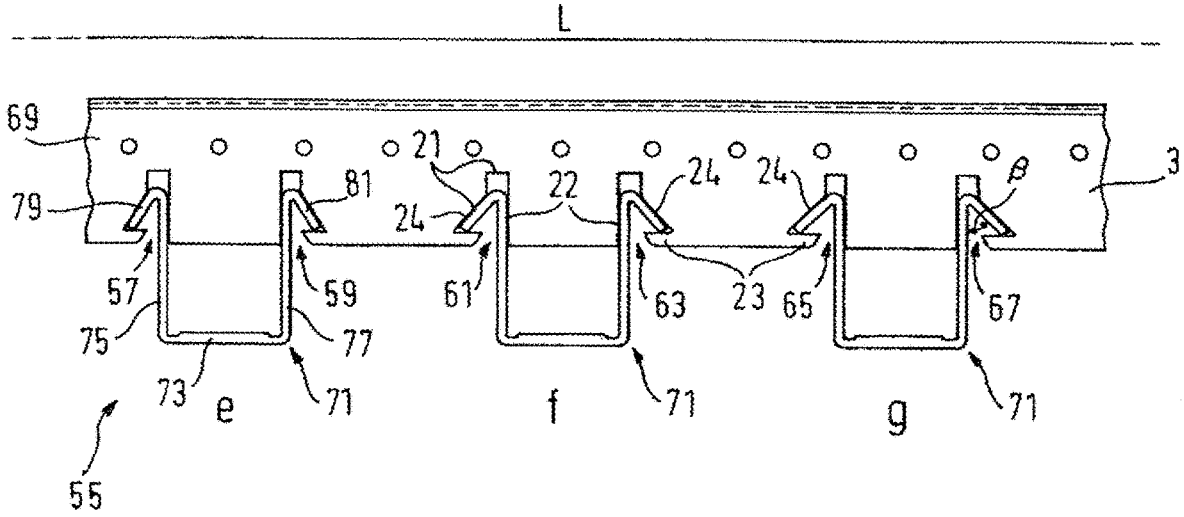

FIG. 7 shows a side view of a further linear ceiling panel mounting system in accordance with the present invention.

Figure 8A:
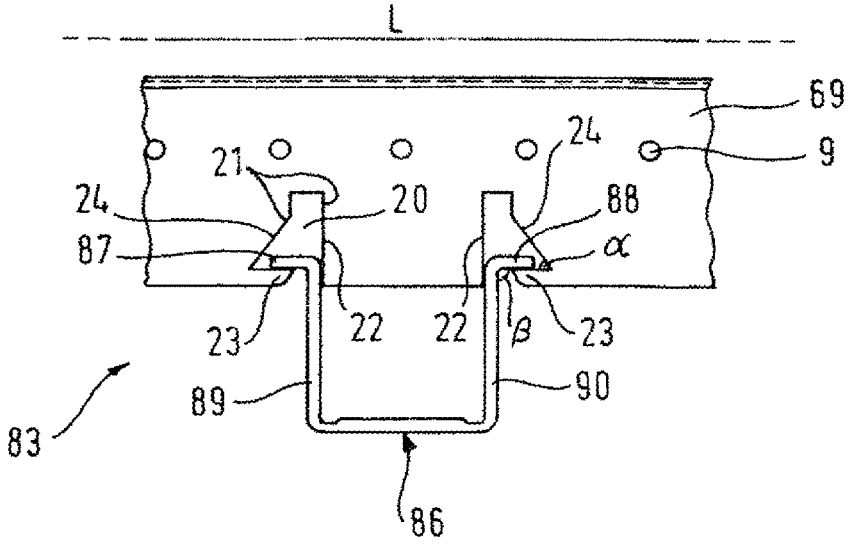
Figure 8B:
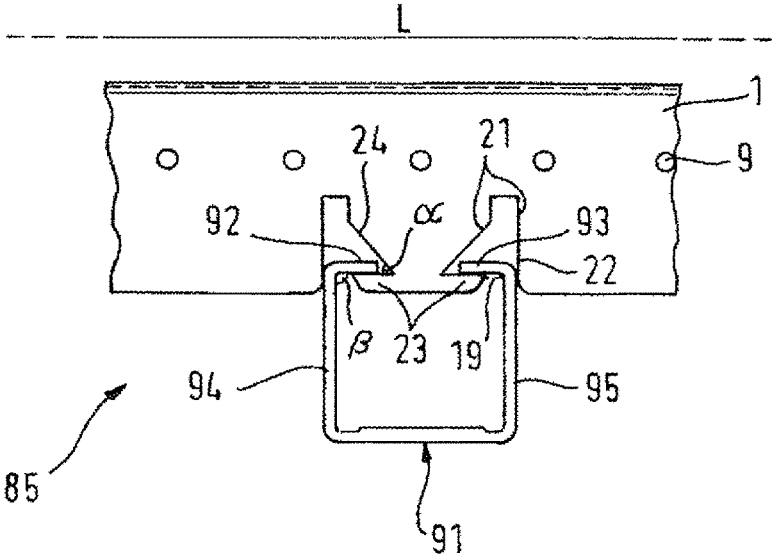

FIGS. 8*a* and 8*b* show side views of two further linear ceiling panel mounting systems in accordance with the present invention.

Figure 1:
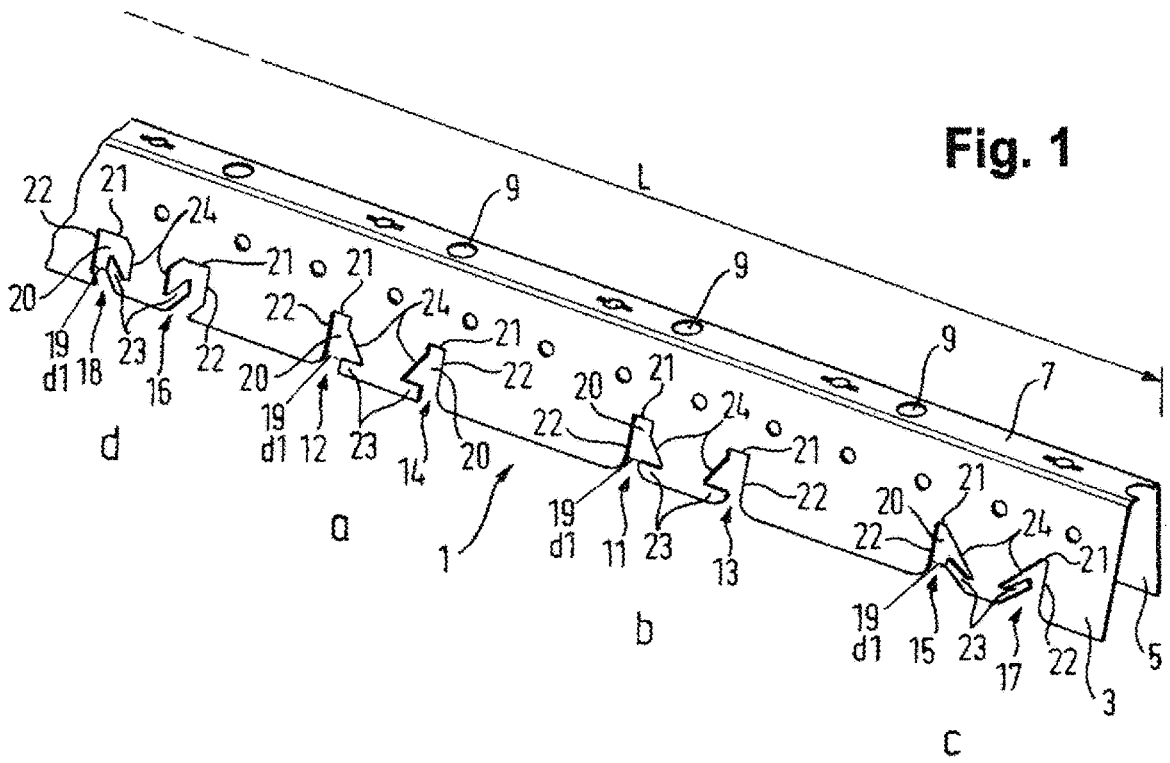
FIG. 1 shows an isometric view of a carrier according to the present invention.

FIG. 1 shows a carrier 1 for mounting linear panels on a ceiling in accordance with the present invention. The carrier 1 extends in a longitudinal direction L and comprises a central portion 7 and two arms 3, 5 which extend from the central portion and which are provided along the longitudinal length of the carrier. The carrier has a cross-sectional shape in the form of an inverted truncated "V". Holes 9 are provided along the central portion of the carrier and/or the arms 3, 5 to permit the carrier to be attached to or suspended from the ceiling.

The carrier 1 is provided with a plurality of recesses 11, 13, 15, 17, 12, 14, 16, 18, arranged in pairs a, b, c, d along the length L of the carrier. Each pair of recesses includes two recesses being the mirror image of each other. Generally, each pair of recesses of the carrier will be identical for ease of manufacture, however, in this example each pair of recesses a, b, c, d is of a different shape to show examples of suitable recess configurations. Other recess configurations may also be suitable. Alternatively, the pair of recesses could include two recesses which are not the mirror image of each other. In this case, the recesses of the pair may be identical or may be different.

Each recess extends through the cross-section of the carrier and is defined by a surface 21. The surface 21 comprises a first wall portion 22 and a second wall portion 24 with the recess between the first and second wall portions. The second wall portion 24 of the surface 21 defines a flange 23 which extends into the recess, thereby providing the recess with a neck portion 19 and a main portion 20. The neck portion 19 is narrower than the main portion 20.

The neck portion 19, at its narrowest point, has a distance d1 of less than 9 mm separating the first wall portion 22 from the second wall portion 24. Flange 23 may have substantially square edges as exemplified by recess pairs a, c, d or may alternatively have rounded edges as recess pair b shows.

Although the carrier of FIG. 1 has an inverted, truncated "V"-shaped cross-section, other cross-sectional shapes such as, for example, inverted or non-inverted "U", "V", "L"-shapes or "omega"-shapes, are also possible. The carrier may exhibit a space between arms 3, 5 as shown in FIG. 1 or may alternatively be formed from a solid bar, having a cross-section as defined above. However, for cost and ease of manufacturing reasons, a carrier having arms with a space between is preferred over a solid bar.

Figure 2:
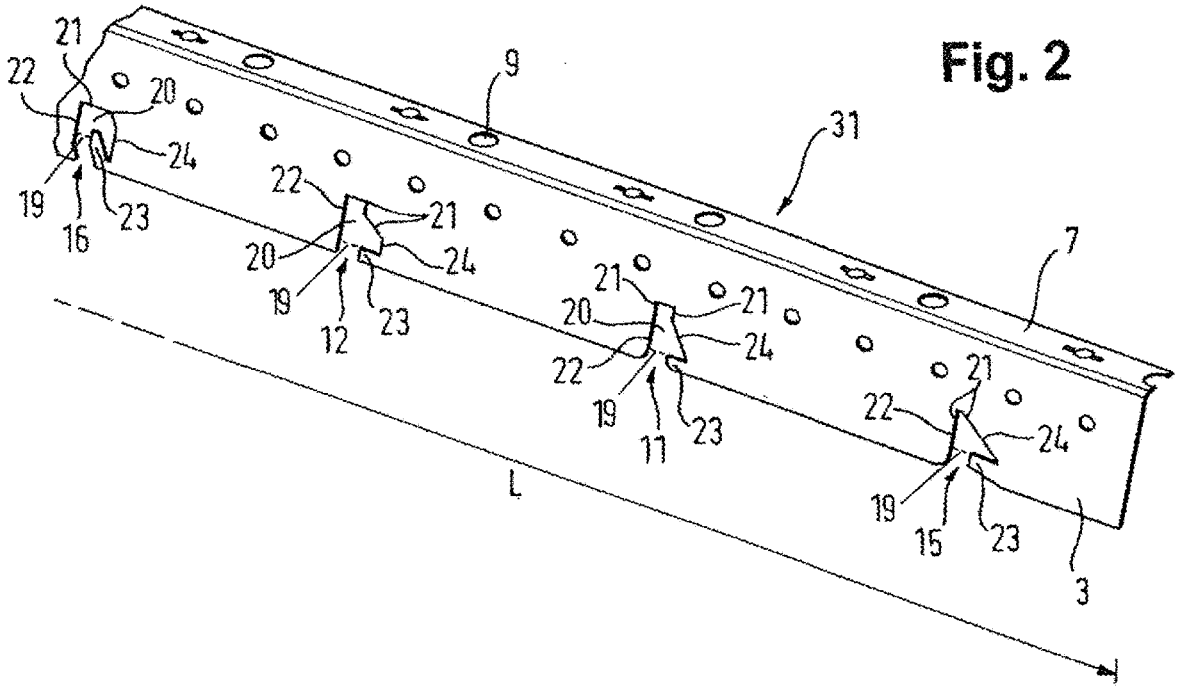
FIG. 2 shows an isometric view of a further carrier in accordance with the present invention.

FIG. 2 shows a carrier 31 for mounting linear panels on a ceiling in a further embodiment of the present invention. In this example, the carrier 31 extends in a longitudinal direction L and comprises a central portion 7 and an arm 3 which extends from the central portion and which is provided along the longitudinal length L of the carrier 31. The carrier has a cross-sectional shape in the form of an inverted "L". Holes 9 are provided along the central portion 7 of the carrier and/or the arm 3 to permit the carrier to be attached to or suspended from the structural ceiling.

The carrier 31 is provided with a plurality of recesses 11, 12, 15, 16 arranged along the length of the carrier. Generally, each recess will be identical for ease of manufacture, however, in this example, each of the recesses 11, 12, 15, 16 are of a different shape to show examples of suitable recess configurations. Other recess configurations may also be suitable.

As described with respect to FIG. 1, each recess extends through the cross-section of the carrier and is defined by a surface 21. The surface 21 comprises a first wall portion 22 and a second wall portion 24 with the recess between the first and second wall portions. The second wall portion 24 of the surface 21 defines a flange 23 which extends into the recess, thereby providing the recess with a neck portion 19 and a main portion 20. The neck portion 19 is narrower than the main portion 20 and, at its narrowest point, the neck portion has a distance d1 of less than 9 mm separating the first wall portion 22 from the second wall portion 24.

The flange 23 may have substantially square edges, as exemplified by recesses 12, 15, and 16, or may alternatively have rounded edges as demonstrated by recess 11.

Although the carrier of FIG. 2 has an inverted "L"-shaped cross-section, other cross-sectional shapes such as, for example, those described above with respect to FIG. 1 are also possible.

FIG. 3 shows a side view of a linear ceiling panel mounting system 33 comprising a carrier 1 similar to that depicted in FIG. 1. For simplicity, all of the pairs of recesses are shown as being identical and have the form of pair b of FIG. 1. It will be appreciated that the pairs of recesses may instead have the form shown as recess pair a, c or d or any other suitable shape of recess. Each of the recess pairs is preferably identical for ease of manufacture.

The linear ceiling panel mounting system 33 further comprises a linear ceiling panel 35. The panel 35 is shaped to facilitate mounting of the panel 35 to the carrier 1. In particular, the panel comprises a central region 37, two side walls 39, 41 and a flange 43, 45 extending from each of the side walls 39, 41. The central region, side walls and flanges may be formed separately but are preferably formed integrally with respect to each other. The flanges 43, 45 of the ceiling panel 35 are formed from a flexible resilient material which permits the flanges to be bent towards the side wall and, when released, to spring back to their original position.

FIGS. 4*a*-4*c* show a linear ceiling panel such as that described with respect to FIG. 3 being mounted in a carrier. FIG. 4*a* shows the panel with its flanges in their original position, just prior to being mounted in the carrier. FIG. 4*b* shows the panel during mounting, and it can be seen that the flanges are bent towards the side walls of the panel to enable the flange to pass through the narrow neck portion. FIG. 4*c* shows the panel once it is mounted to the carrier and the flanges have passed through the neck portion of the recess and, due to their resilient nature, have sprung back into their original position insofar as surface 21 defining the main portion 20 of the recess permits.

The flanges 43, 45 are configured to fit within the corresponding recesses 11, 13 of the carrier. The angle β between the side wall and the flange is, in this example, approximately 35°, although other angles β, preferably in the range of 10°-100°, may be used instead. The flanges retain some flexibility due to the nature of the material from which they are made, and are able to be bent towards the side wall, as shown in FIG. 4*b*, thereby decreasing the angle β. As the flanges are able to be bent sufficiently to allow the flange and the adjacent part of its associated side wall to pass through the neck portion of the recess, the flanges and their adjacent side walls are able to be inserted into their respective recesses 11, 13 of the carrier. Once inserted, the resilient flanges will have a tendency to spring back to their original shape as shown in FIG. 4*c*, thereby wedging themselves securely in the recess. The flexible and resilient nature of the flanges ideally allows the flanges to be bent such that β is very small, preferably less than 10°, and may approach or reach zero. The flange will then be substantially parallel to, and almost or actually touching the side wall. In this configuration, the flange and adjacent side wall are able to be inserted together through the thin neck portion 19 of the recess. The neck portion 19 needs to have a gap d1 large enough to permit insertion of the flange and adjacent side wall, and should therefore be at least the thickness of the flange plus the thickness of the adjacent side wall for substantially incompressible materials which are flexible enough to permit the flange to be bent such that β is substantially zero. Once the flange is no longer constrained by the neck portion, it springs back to its original shape, in so far as the surface 21 defining the main portion 20 of the recess permits. Over time, and especially if the ceiling panels are subjected to humidity or excess heat, the flanges may start to "open out", i.e. bend away from the side walls, the angle β tending to increase. However, due to the configuration of the recess, the flange is constrained and is not able to "open out" due to the surface 21 defining the recess. Thus, the flange of the panel is securely retained in the recess, without the need for additional retaining means such as adhesives or mechanical fasteners (e.g. screws or bendable locking lips provided on the carrier).

Although the panel central region 37 is shown in this example as being substantially parallel to the carrier, the panel central region 37 may be angled with respect to the carrier. Similarly, the panel side walls may be provided at an angle other than 90° with respect to the panel central region 37.

The linear ceiling panels 35 are mounted in the carrier 1 such that they extend longitudinally in a direction substantially perpendicular to the longitudinal direction L of the carrier 1. FIG. 5 shows a linear ceiling panel mounting system comprising a plurality of carriers 1 and panels 35, the carriers being suspended from a ceiling. The spacing between each recess of a pair of recesses determines the width of the linear ceiling panel and the spacing between recess pairs determines the spacing between adjacent linear panels. These spacing parameters will be determined according to the architectural requirements for the building, including its desired acoustic properties and cooling mechanisms, for example.

FIG. 6 shows a side view of a linear ceiling panel mounting system 50 comprising a carrier 31 similar to that depicted in FIG. 2. For simplicity, all of the recesses 51*a, b, c* are shown as being identical and have the form of the recess 12 of FIG. 2. It will be appreciated that the recesses may instead have the form shown as recess 11, 15 or 16 or any other suitable shape of recess. The recess may alternatively be in the form of a mirror image of those recesses depicted, or may comprise recess pairs such as those shown in FIGS. 1 and 3, for example.

The linear ceiling panel mounting system 50 further comprises a linear ceiling panel 47 in the form of a baffle. The panel 47 is shaped to facilitate mounting of the panel to the carrier 31. In particular, the panel comprises a baffle portion 53 and a flange 49 which extends from the baffle portion 53. The flange 49 is formed from a flexible, resilient material as described with respect to FIG. 3. The baffle portion 53 and flange 49 may be formed separately but are preferably formed integrally with respect to each other.

The linear ceiling panels 47 are mounted in the carrier 31 such that they extend longitudinally in a direction substantially perpendicular to the longitudinal direction L of the carrier 31 (i.e. through the plane of the paper in FIG. 3) in a manner similar to the panels depicted in FIG. 5. The longitudinal length of the panels 47 is preferably at least $3\times(l_1+l_2)$ where $l_1$ is the length of the baffle portion 53 and $l_2$ is the length of the flange 49, and more preferably at least $5\times(l_1+l_2)$.

As for the linear ceiling panel mounting system 33 of FIG. 3, the flanges 49 of the linear ceiling panel mounting system 50 are configured to be received and retained within the corresponding recesses 51*a, b, c* of the carrier 31. In this manner the panels 47 may be mounted on the carrier 31 without the need for adhesives or mechanical fasteners (e.g. screws).

FIG. 7 shows a side view of an alternative linear ceiling panel mounting system 55. The linear ceiling panel mounting system 55 comprises a carrier 69 which is similar to that depicted in FIGS. 1 and 3 except that the recesses 57, 59, 61, 63, 65, 67 which make up recess pairs e, f, g, respectively are mirror images of the recesses 11 and 13 as shown in FIG. 3. Again, it will be appreciated that the pairs of recesses e, f, g may instead be mirror images of the recesses 12 and 14 (recess pair a) or mirror images of the recesses 15 and 17 (recess pair c) or minor images of the recesses 16 and 18 (recess pair d) which appear in FIG. 1. Any other suitable shape of recess may alternatively be used. Again, each of the recess pairs e, f, g are preferably identical for ease of manufacture.

The linear ceiling panel mounting system 55 further comprises a linear ceiling panel 71. The panel 71 is shaped to facilitate mounting a panel to the carrier 69. In particular, the panel 71 comprises a central region 73, two side walls 75, 77 and a flange 79, 81 extending from each of the side walls 75, 77. The flanges 79, 81 are formed from a flexible, resilient material as described with respect to FIG. 3. The central region side walls and flanges may be formed separately, but are preferably formed integrally with respect to each other. However, instead of extending inwardly of the side walls as in the previous examples, the flanges 79, 81 extend outwardly of the side walls 75, 77 as can be seen in FIG. 7. Again, the flanges 79, 81 are sufficiently flexible to be bent towards the side walls as the flanges and their adjacent side walls are inserted into their respective recesses 57, 59 via the neck portion of the recesses. Once inserted, the resilient flanges spring back to their original shape in so far as the surface 21 defining the main portion 20 of the recesses permits. Again, the flanges 79, 81 are configured to fit and be retained within the corresponding recesses 57, 59 of the carrier 69, the surface 21 securely retaining the flanges in the recess. As for the previous examples, the linear ceiling panels 71 are mounted in the carrier 69 such that they extend longitudinally in a direction perpendicular to the longitudinal direction L of the carrier 69 (i.e. through the plane of the paper in FIG. 6). Although the central regions 73 of the panels 71 are shown in this example as being substantially parallel to the carrier, the panel central regions 73 may be angled with respect to the carrier. Similarly, the panel side walls 75, 77 may be provided at an angle other than 90° with respect to the panel central region 73.

FIGS. 8*a* and 8*b* show side views of further alternative linear ceiling panel mounting systems 83, 85. FIG. 8*a* shows a linear ceiling panel mounting system 83 comprising a carrier 70 similar to that shown in FIG. 7, but with different shaped recesses 52, 54, and further comprising a linear ceiling panel 86. The panel 86 is identical to those panels described with respect to FIG. 7 except that the flanges 87, 88 are formed so as to extend at substantially right angles from the side walls 89, 90 (i.e. in this example β is approximately 90°). FIG. 8*b* shows a linear ceiling panel mounting system 85 comprising a carrier 72 similar to that shown in FIG. 3, but with different shaped recesses 56, 58, and further comprising a linear ceiling panel 91. The panel is identical to those panels described with respect to FIG. 3 except that the flanges 92, 93 extend at substantially right angles from the side walls 94, 95 (i.e. in this example β is approximately 90°). Again, the flexible, resilient flanges 87, 88 of the panels 86, 91 of FIGS. 8*a* and 8*b* are retained in the recesses of carriers 70, 72 by the surface 21 of the recesses, without the need for adhesives or mechanical fasteners (e.g. screws). As for the previous example, the linear ceiling panels 86, 91 are mounted in the carriers 70, such that they extend longitudinally in a direction perpendicular to the longitudinal direction L of the carriers 70, 72 (i.e. through the plane of the paper in FIGS. 8*a* and 8*b*).

Although specific angles β are described above, the panels may be formed such that the angle β between the flange and the adjacent side wall of the panel may be any angle which permits the flange, when in its original position, to be retained in the recess of the carrier. A suitable range would be, for example, $10°\leq\beta\leq100°$.

The flanges (and indeed the panel as a whole) may be formed from any suitable flexible, resilient material. Non-limiting examples of such materials might include fibrous materials including thermoformable, non-woven fibrous materials; metal; a mixture of metal and fibrous material; rubbers; etc.

The invention claimed is:

1. A linear panel mounting system, comprising:

a carrier extending in a longitudinal direction and having a recess formed therein, the recess having a neck portion and a main portion, with the neck portion corresponding to a narrowed section of the recess relative to the main portion of the recess; and a linear panel including a flexible, resilient flange extending at an angle from an adjacent wall of the panel along at least a portion of an edge of the panel;

wherein:

the flange is configured to be bent towards the adjacent wall to reduce the angle to a reduced angle as the flange passes through the neck portion of the recess to permit both the flange and a portion of the adjacent wall to be inserted through the neck portion of the recess;

the reduced angle is an acute angle; and the flange is configured to spring away from the adjacent wall once the flange clears the neck portion of the recess to allow the flange to be retained within the recess.

2. A linear panel mounting system in accordance with claim 1, wherein the carrier is configured to be mounted to a wall such that the linear panel is suspended relative to the wall.

3. A linear panel mounting system in accordance with claim 2, wherein the wall forms at least a portion of a ceiling.

4. A linear panel mounting system in accordance with claim 2, wherein the wall comprises a wall extending adjacent to a ceiling.

5. A linear panel mounting system in accordance with claim 1, wherein:

the recess extends through the cross-section of the carrier and is defined by a surface comprising at least a first wall portion and a second wall portion; and the recess separates the first wall portion from the second wall portion; and the second wall portion defines a carrier flange which extends at least partially into the recess to form the neck portion of the recess.

6. A linear panel mounting system in accordance with claim 1, wherein:

the linear panel includes a central region and first and second side walls extending from the central region; and the adjacent wall comprises one of the first side wall or the second side wall such that the flange extends from the one of the first side wall or the second side wall.

7. A linear panel mounting system in accordance with claim 6, wherein:

the recess comprises a first recess of the carrier and the carrier further includes a second recess formed therein;

the flange comprises a first flange extending from the first side wall;

the panel further comprises a second flexible, resilient flange extending from the second side wall at a second angle, with the second flange configured to be bent towards the second side wall to reduce the second angle to a second reduced angle as the second flange passes through a neck portion of the second recess;

the second reduced angle is an acute angle; and the second flange is configured to spring away from the second side wall once the second flange clears the neck portion of the second recess to allow the second flange to be retained within the second recess.

8. A linear panel mounting system in accordance with claim 1, wherein:

the carrier is one of a plurality of carriers, with each carrier of the plurality of carriers comprising at least one recess formed therein;

the linear panel is one of a plurality of linear panels, each panel of the plurality of linear panels having a flexible, resilient flange extending at least partially along an edge of the panel; and the at least one recess formed in each carrier is configured to receive a flange of a respective panel of the plurality of linear panels.

9. A linear panel mounting system in accordance with claim 1, wherein the resilience of the flange acts to retain the angle defined between the flange and the adjacent wall at approximately 90° or less.

10. A linear panel mounting system in accordance with claim 9, wherein the angle of the flange with respect to the adjacent wall is reduced to an acute angle of 10° or less when the flange and the portion of the adjacent wall are inserted through the neck portion of the recess.

11. A method of mounting a linear panel relative to a carrier, the carrier having a recess formed therein, with the recess including a neck portion and a main portion, the linear panel including a flexible, resilient flange extending at an angle from an adjacent wall of the panel along at least a portion of an edge of the panel, the method comprising:

initially inserting the flange into the neck portion of the recess, the neck portion corresponding to a narrowed section of the recess relative to the main portion of the recess;

pushing the flange through the neck portion of the recess such that the flange bends towards the adjacent wall to reduce the angle to a reduced angle to permit both the flange and a portion of the adjacent wall to pass through the neck portion of the recess, the reduced angle being an acute angle; and further inserting the flange into the recess such that the flange springs away from the adjacent wall upon clearing the neck portion of the recess to allow the flange to be retained within the main portion of the recess.

12. A method in accordance with claim 11, wherein the carrier is configured to be mounted to a wall such that the linear panel is suspended relative to the wall when the flange is retained within the recess.

13. A method in accordance with claim 12, wherein the wall forms at least a portion of a ceiling.

14. A method in accordance with claim 12, wherein the wall comprises a wall extending adjacent to a ceiling.

15. A method in accordance with claim 11, wherein the resilience of the flange acts to retain the angle defined between the flange and the adjacent wall at approximately 90° or less when the flange is at an original unbent position relative to the adjacent wall.

16. A method in accordance with claim 15, wherein pushing the flange through the neck portion of the recess comprises pushing the flange through the neck portion of the recess such that the flange transitions from the original unbent position to a bent position relative to the adjacent wall at which the angle of the flange with respect to the adjacent wall is reduced to an acute angle of 10° or less.

17. A method in accordance with claim 15, wherein pushing the flange through the neck portion of the recess comprises pushing the flange through the neck portion of the recess such that the flange transitions from the original unbent position to a bent position relative to the adjacent wall at which the angle of the flange with respect to the adjacent wall is reduced to an acute angle of 5° or less.

18. A method in accordance with claim 15, wherein further inserting the flange into the recess comprises pushing the flange into the main portion of the recess such that the flange clears the neck portion of the recess and transitions from the bent position back to the original unbent position as the flange springs away from the adjacent wall.

19. A method in accordance with claim 11, wherein:

the linear panel includes a central region and first and second side walls extending from the central region;

the recess comprises a first recess of the carrier;

the carrier further includes a second recess formed therein having a neck portion and a main portion, with the neck portion of the second recess corresponding to a narrowed section of the second recess relative to the main portion of the second recess;

the adjacent wall comprises the first side wall and the flange comprises a first flange extending from the first side wall; and the panel further comprises a second flexible, resilient flange extending from the second side wall at a second angle.

20. A method in accordance with claim 19, wherein:

initially inserting the flange into the neck portion of the recess comprises initially inserting both the first flange into the neck portion of the first recess and the second flange into the neck portion of the second recess;

pushing the flange through the neck portion of the recess comprises pushing the first and second flanges through the neck portions of the first and second recesses, respectively, such that the first flange bends towards the first side wall to reduce the angle to the reduced angle to permit both the first flange and a portion of the first side wall to pass through the neck portion of the first recess and the second flange bends towards the second side wall to reduce the second angle to a second reduced angle to permit both the second flange and a portion of the second side wall to pass through the neck portion of the second recess, each of the reduced angle and the second reduced angle being an acute angle; and further inserting the flange into the recess comprises further inserting the first and second flanges into the first and second recesses, respectively, such that the first flange springs away from the first side wall upon clearing the neck portion of the first recess to allow the first flange to be retained within the main portion of the first recess and the second flange springs away from the second side wall upon clearing the neck portion of the second recess to allow the second flange to be retained within the main portion of the second recess.

* * * * *